US006591569B2

(12) United States Patent
Azar

(10) Patent No.: US 6,591,569 B2
(45) Date of Patent: Jul. 15, 2003

(54) BUILDING BLOCKS

(76) Inventor: Tony Azar, 3555 North Service Road East, Windsor, Ontario (CA), N8W 5R7

( * ) Notice: Subject to any disclaimer, the term of this patent is extended or adjusted under 35 U.S.C. 154(b) by 0 days.

(21) Appl. No.: 10/006,325

(22) Filed: Dec. 5, 2001

(65) Prior Publication Data

US 2003/0079432 A1 May 1, 2003

(30) Foreign Application Priority Data

Oct. 25, 2001 (CA) ..... 2359923

(51) Int. Cl.[7] ..... E04B 5/04; E04C 2/04

(52) U.S. Cl. ..... 52/604; 52/605; 52/606; 52/608; 52/609

(58) Field of Search ..... 52/596, 604, 605, 52/606, 608, 609, 610, 612, 561

(56) References Cited

U.S. PATENT DOCUMENTS 2,340,526 A * 2/1944 Green
2,919,634 A * 1/1960 Plotner
3,221,614 A * 12/1965 Pertien
3,870,423 A * 3/1975 Peitz, Jr. ..... 404/41
4,016,692 A * 4/1977 Jordan et al. ..... 52/314
4,593,513 A * 6/1986 Stratton ..... 52/578
4,773,790 A * 9/1988 Hagenah ..... 404/41
5,286,139 A * 2/1994 Hair ..... 404/41
5,921,705 A * 7/1999 Hodson et al. ..... 404/41
5,930,964 A * 8/1999 Boehning ..... 52/309.1
6,108,995 A * 8/2000 Bouchard et al. ..... 52/609
6,226,951 B1 5/2001 Azar
6,253,518 B1 * 7/2001 Azar ..... 52/589.1

* cited by examiner

*Primary Examiner*—Carl D. Friedman
*Assistant Examiner*—Yvonne M. Horton
(74) *Attorney, Agent, or Firm*—Anthony J. Casella; Gerald E. Hespas

(57) ABSTRACT

A building block for use in construction, comprises a first and second side wall. First and second end walls join the first side wall to the second side wall at the respective ends thereof. A top surface and a bottom surface are also provided. The top and bottom surfaces are profiled to interfit with one another. The block is characterized in that each end wall is substantially Z-shaped.

24 Claims, 5 Drawing Sheets

BUILDING BLOCKS

FIELD OF THE INVENTION

The present invention relates to the field of building blocks, particularly concrete blocks.

The present invention provide a novel concrete block for use as a dry stacking block, or for use with mortar.

BACKGROUND OF THE INVENTION

Traditionally, blocks are substantially rectangular with smooth end surfaces and smooth side surfaces. Blocks generally have been provided with flat top and bottom surfaces, and they may have hollow interior cores. In the case of blocks with hollow cores, the hollow core cavity usually extends from top to bottom, and it is usually divided by a solid wall or web integral with, and extending between, the side walls of the block. The blocks are laid in horizontal courses, with mortar between each block in a course, and mortar between the courses. Constructing a wall or other structure with blocks and mortar produces a strong structure, but requires skilled labour, and much time. Moreover, it requires the on-site preparation of mortar on a continuous basis, either by the skilled tradesmen, or by additional labour.

It will be appreciated then, that a need exists for a block which can be used by relatively unskilled labour to build a wall in a reasonable period of time. For that reason, various dry stacking blocks have been developed. Dry-stacking blocks are blocks that can be assembled into a wall or other structure by unskilled labour, without the use of mortar. After assembly, concrete or grout is poured into the hollow cores of the blocks, forming an internal matrix of concrete. A particularly successful and useful dry stack block is described in applicant's issued U.S. Pat. No. 6,226,951. In that patent, a dry-stack block is described with interlocking ends and interlocking top and bottom surfaces. A corner block is also provided. Applicant's previous block design provides a substantial space between the end surfaces of adjacent blocks in a course, with block-to-block contact being effected only at the side surfaces, which are provided with interlocking notches. Such a substantial space ensures that there is no continuous unfilled void between blocks, and also ensures that there is no unsealed surface extending from one side of a wall constructed of the blocks to the other side thereof.

The block of the present invention achieves similar aims to that of applicant's aforementioned U.S. patent, but with a different configuration offering several advantages.

In particular, the block of the present invention is distinguished by the absence of extensions from the side walls that create a fillable void between adjacent blocks in the same course.

The block of the present invention, on the other hand, provides a series of vertically oriented water flow channels that channel water that may enter from one side of a wall, between two blocks, in a downward direction, so that it will not penetrate from one side of a wall to the other.

The block of the present invention is provided with a profiled end that interfits with a complementary profile shaped in the side wall in a corner block according to the present invention.

The block of the present invention may be used with or without mortar. Even is used with mortar, it does not require skilled labour to assemble a wall using the block of the present invention.

In a broad aspect, then, the present invention relates to a building block for use in construction, comprising: i) a first and second side walls; ii) first and second end walls joining said first side wall to said second side wall at the respective ends thereof; iii) a top surface; and iv) a bottom surface, said top and bottom surfaces being profiled to interfit with one another; characterized in that each said end wall is substantially Z-shaped.

In another broad aspect, the present invention relates to a building block for use in construction, further characterized in that each said Z-shaped end wall includes an inwardly bevelled portion adjacent the first side wall, an outwardly bevelled portion adjacent said second side wall, and an angled portion extending between the inner ends of said inwardly and outwardly bevelled portions.

BRIEF DESCRIPTION OF THE DRAWINGS

In drawings that illustrate the present invention by way of example.

DETAILED DESCRIPTION

Figure 1:
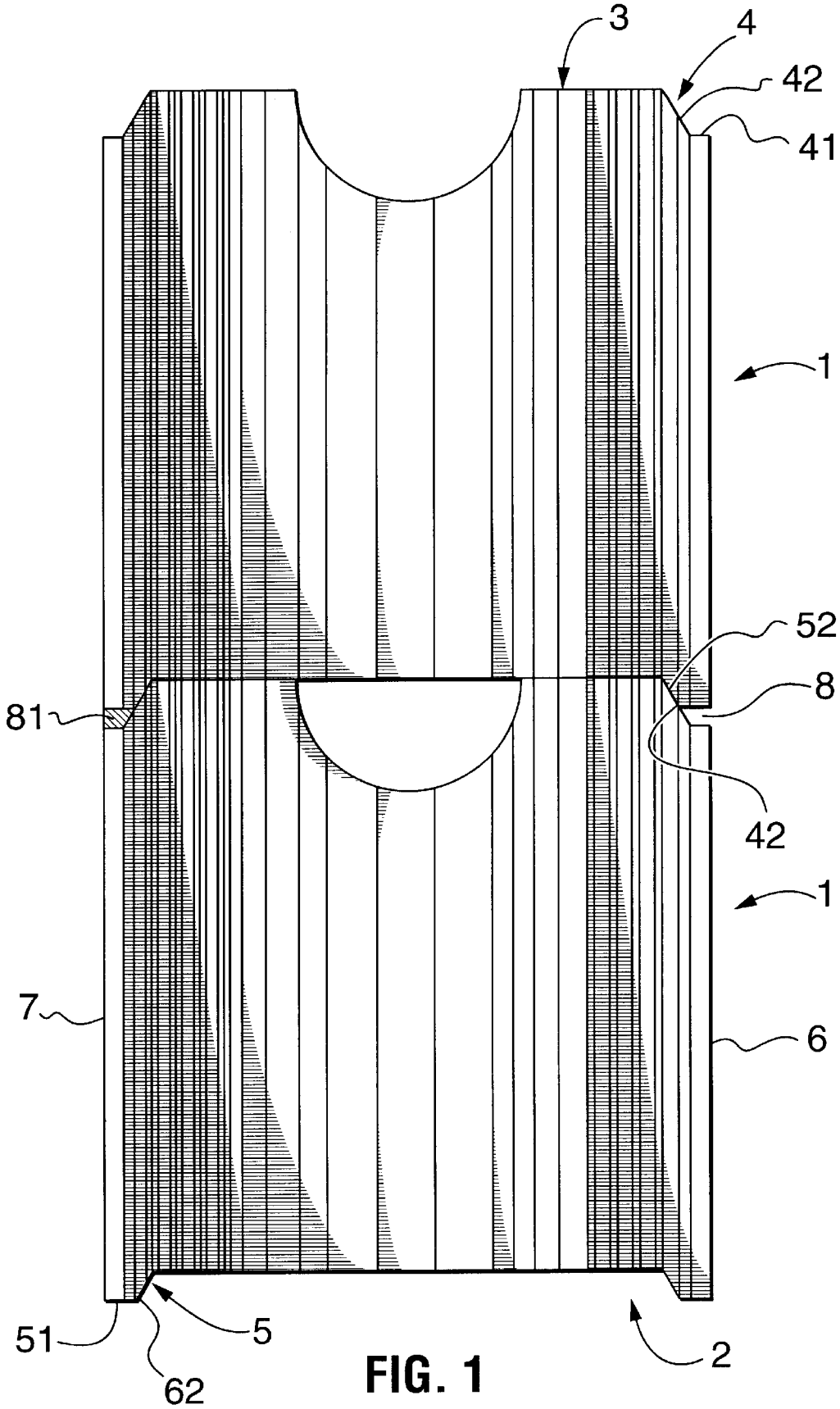
FIG. 1 is an end view of two stretcher blocks according to the present invention, stacked on top of each other.

Referring first of FIG. 1 the drawings, the interlocking fit, from course to course, of the blocks of the present invention is illustrated. The present invention provides blocks 1 with top surfaces 3 and bottom surfaces 2, the bottom surface 2 being profiled as a wide channel with downwardly depending flanges 5 at each side thereof, the flanges 5 being configured as downward extensions of the side walls 6,7 of the block. The top surface 3 of the block is profiled in a manner complementary to the bottom surface 2, to accommodate blocks being stacked on it. That is, at each side of the top surface 3 block, extending the length thereof, is formed a lip 4 complementary in profile to flange 5. The profile of the flange 5 consists of a flat lower surface and a bevelled surface 52. Lip 4 consists of a bevelled surface and a flat outer surface 41. It will be seen that when the blocks are stacked on one another, the bevelled surface 52 of the flange 5 fits snuggly against bevelled surface 42 of the lip 4. There is a gap 8 between the flat surfaces 51 and 41 of the flanges 5 and lips 4, for aesthetic purposes, and as a channel into which a liquid sealant 81 such as a resilient silicone sealant can be placed after assembly. As can be seen from FIG. 9, a similar channel 91 will be formed between adjacent blocks in a course, also for aesthetic and/or sealant placement purposes.

Figure 2:
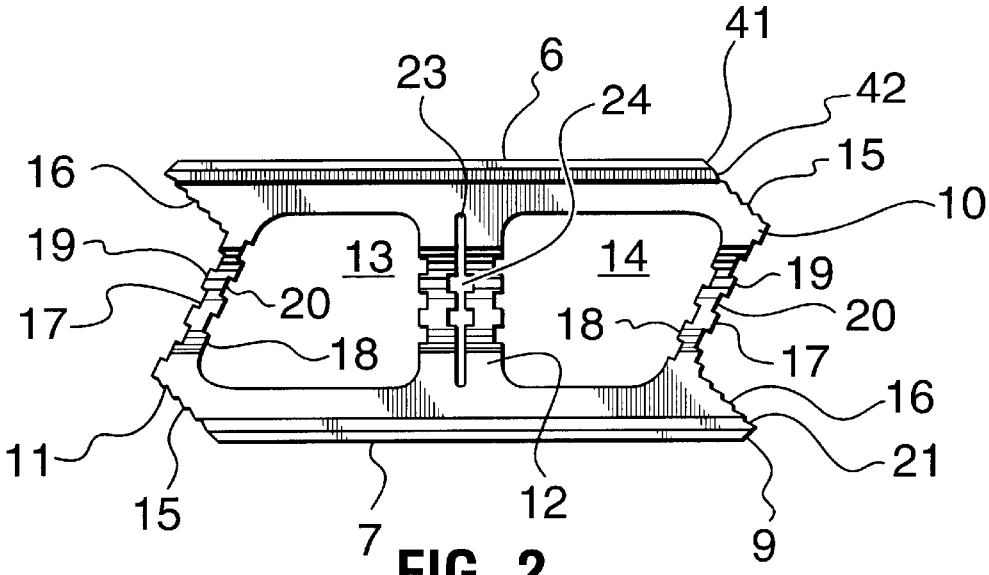
FIG. 2 is a top view of a stretcher block according to the present invention.
Figure 3:
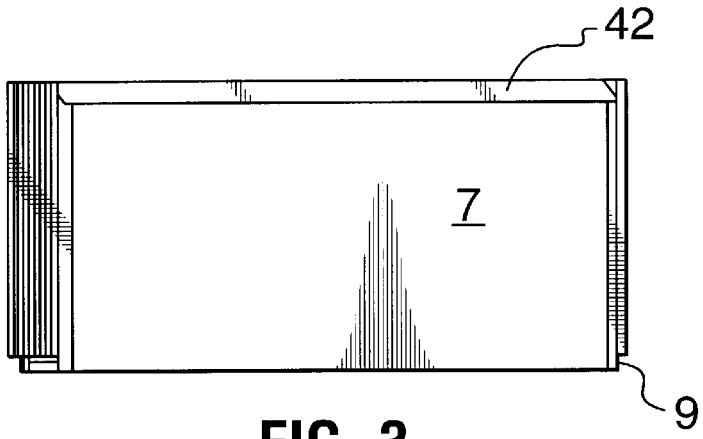
FIG. 3 is a side view of the block of FIG. 2.
Figure 4:
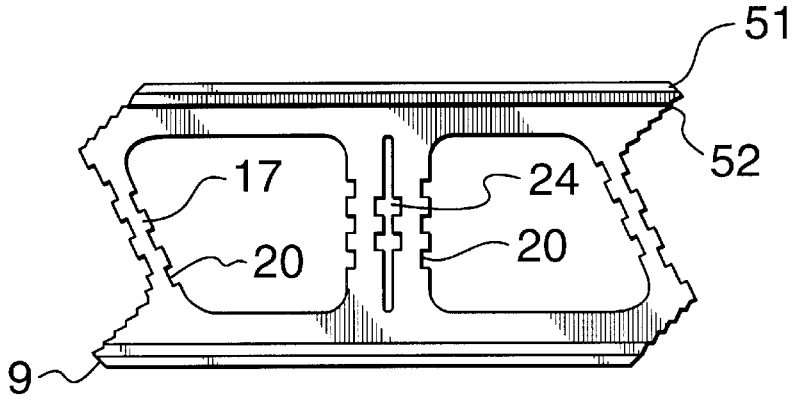
FIG. 4 is a bottom view of the block of FIG. 2.

FIGS. 2, 3 and 4 illustrate other views of the stretcher block shown in FIG. 1. Each block has two sides 6,7 separated by end walls 10 and 11 and central web 12.

Vertically oriented hollow cores 13,14 are formed between the side walls 6,7 and the end walls 10,11 and central web 12. The end walls 10,11 are substantially Z-shaped with outward and inward bevelled side portions 15,16 joined together by an angled central portion 17. The central angled portion 17 of the end walls 10,11 is grooved on its inner 18 and outer 19 surfaces with grooves 20 that may be square cut, semi-circular or any other desired shape. Furthermore, on the outer surface 19, the grooves 20 may be located in a shallow depression 22. Depression 22 may, however, be eliminated, in favour of forming grooves 20 directly in outer surface 19. Moreover, each of the bevelled side portions 15,16 of the end walls has a series of grooves 21 in its surface. As can be observed from FIG. 9, depressions 22 on the outer surfaces 19 of the central portions 17 of two adjacent blocks align to form a narrow channel lined with grooves 20 between adjacent blocks. This channel will align with channel 23 that is provided with grooves 23, in the central web 12 of the block below it, when one course of blocks is laid on another in a running bond pattern, as shown in FIG. 9.

Figure 9:
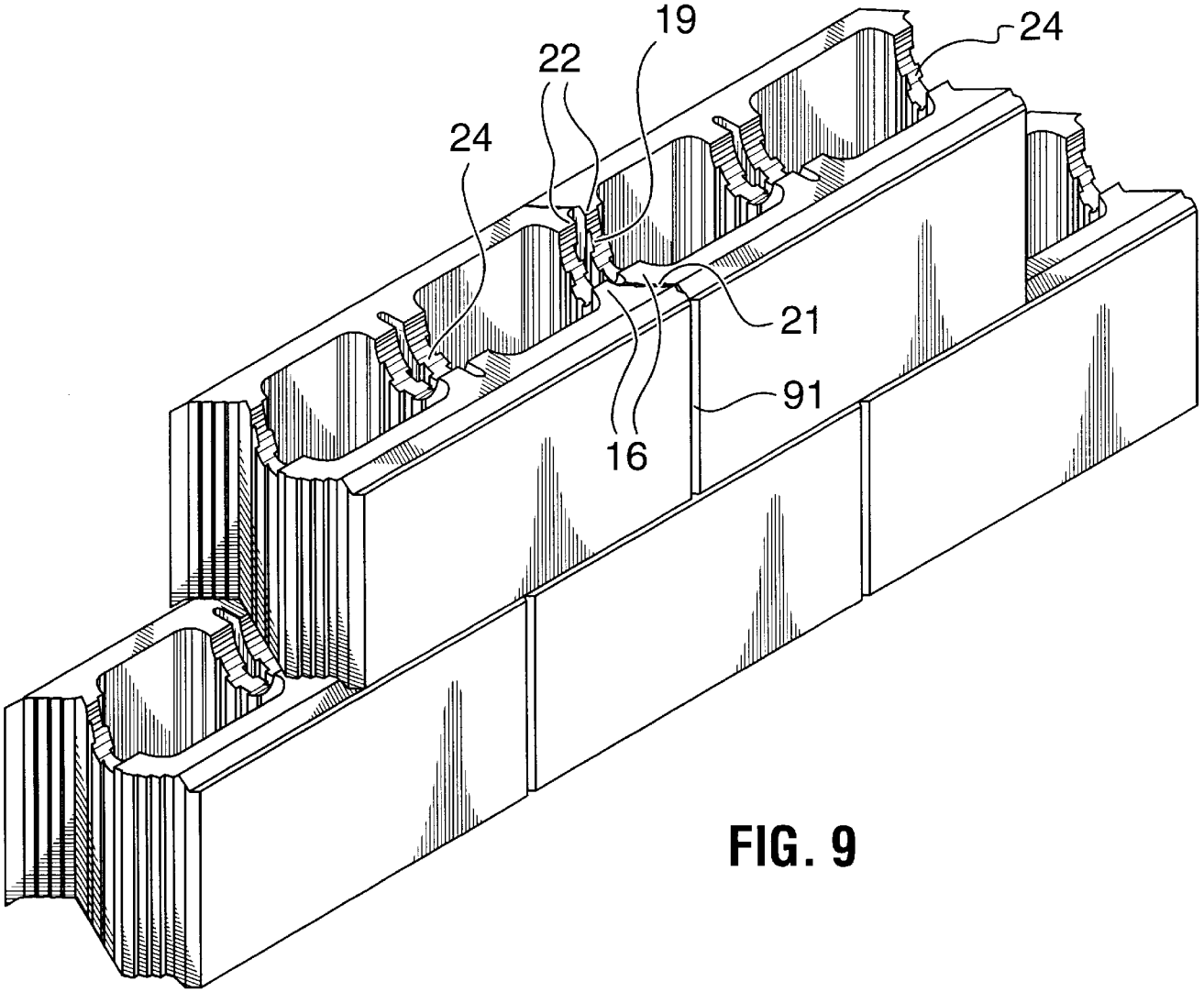
FIG. 9 is a perspective topside view of a partly constructed wall using stretcher blocks according to the present invention.

Also as shown in FIG. 9, when adjacent blocks in a course are laid, the bevelled portions of the end walls interfit and grooves 21 therein align to form channels between the adjacent blocks, to channel any water that may enter between the blocks downwardly, so it will not pass from one side of the blocks to the other. As can also be seen from FIG. 9, the upper surfaces of the central web 12 and the end walls 10, 11 may, if desired, be provided with semi-circular cut-outs 24 (any other suitable shape will also be appropriate) to add in the flow of concrete or grout from core 13 to core 14 in a block and between adjacent blocks. Cut-outs 24 also provide a channel in the top surface 3 of each course of blocks for the placement of rebar, which can also be inserted vertically in the aligned cores of blocks after placement.

At the end of each side wall of the block adjacent inward bevelled portion 16 of end wall 10/11 is formed a short counter-bevelled surface 9. Surface 9 will be situated next to outward bevelled end wall portion 15 in the adjacent block, and thereby form grooves 91 (see FIG. 9) that are aesthetically pleasing, and may be filled with sealant.

Figure 5:
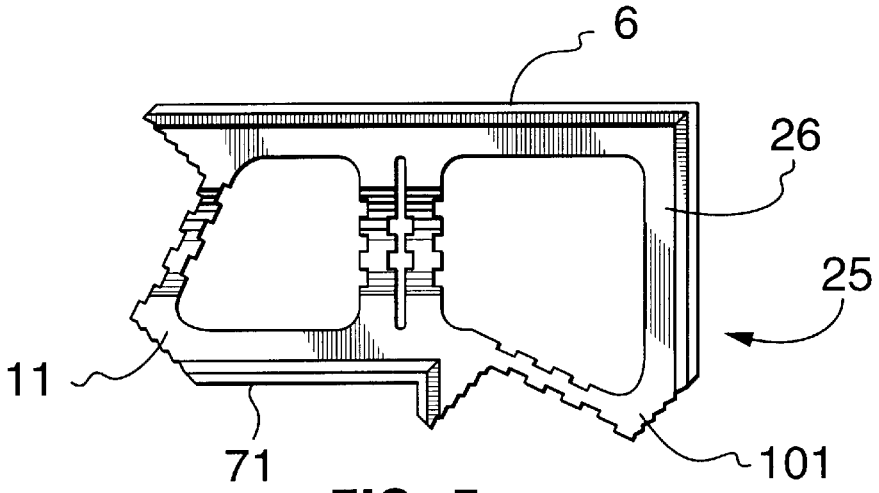
FIG. 5 is a top view of a right corner block according to the present invention.
Figure 6:
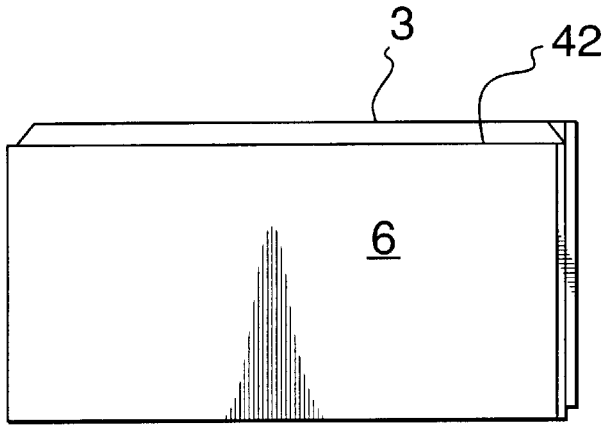
FIG. 6 is a side view of one side of the block of FIG. 5.
Figure 7:
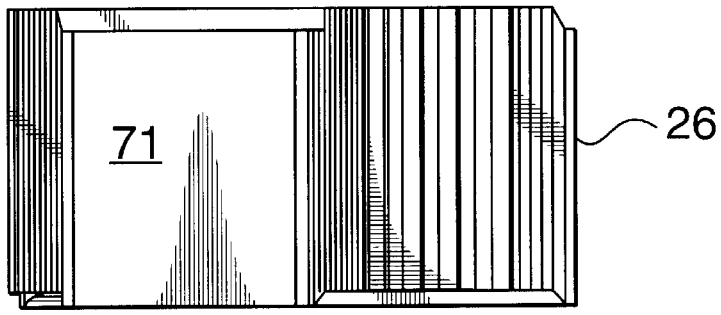
FIG. 7 is a side view of the right side of the block.
Figure 8:
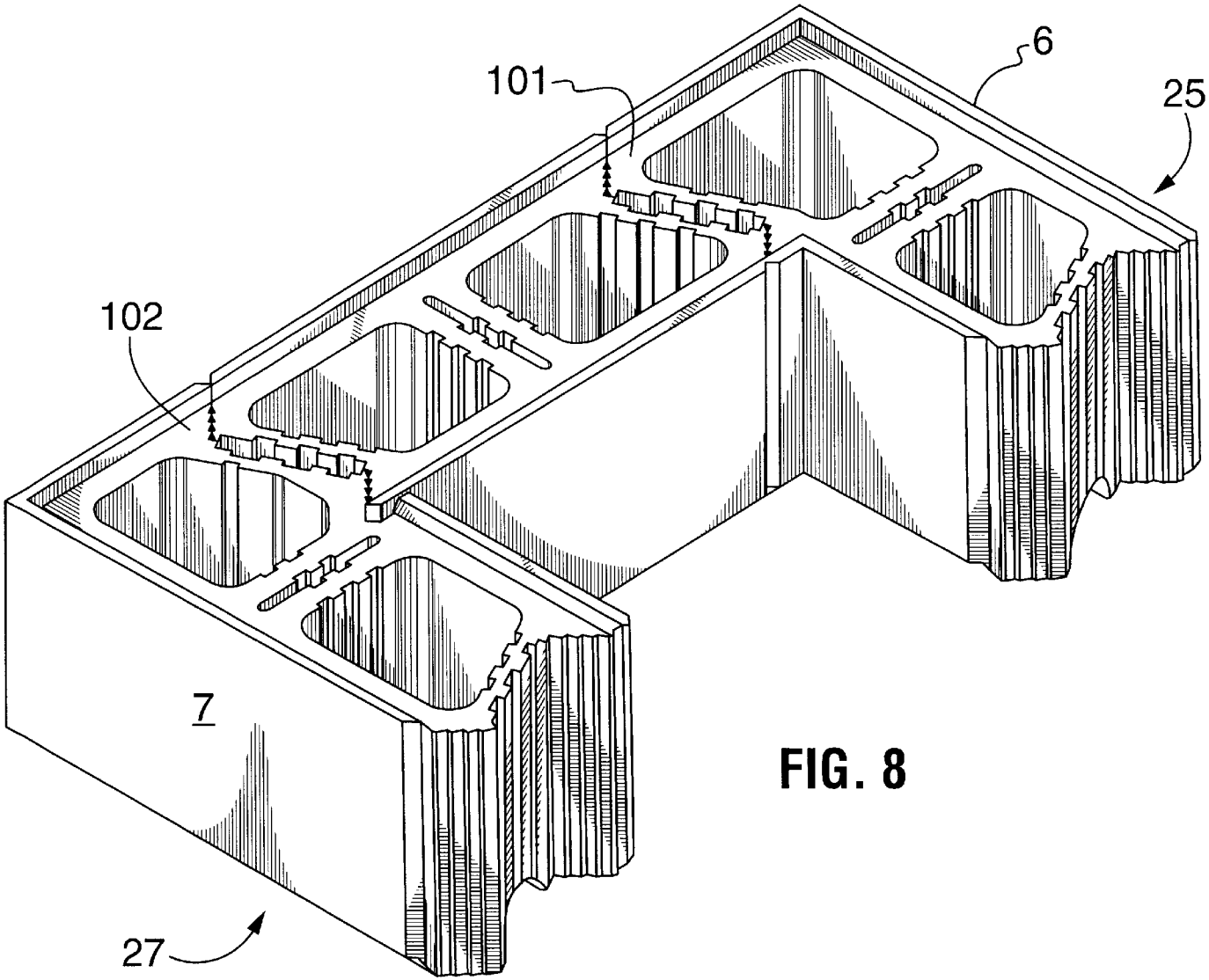
FIG. 8 is a perspective underside view of a stretcher, a right corner and a left corner block according to the present invention.

Referring now to FIGS. 5, 6 and 7, a corner block 25 for forming right hand corners is shown. Corner block 25 resembles the stretcher block in all essential respects including the provision of a Z-shaped end wall 11 at one end. The opposed end wall 101 is formed in a side wall 71, and all features of same are otherwise unchanged from a stretcher block 1, other than that the opposite end wall 26 is flat. Referring to FIG. 8, a right corner block 25 is illustrated interfit with a stretcher block 1, which is interfit with a left corner block 27. It will be observed that the Z-shaped corner end wall 101 in a right hand corner block 25 extends outwardly slightly from its adjacent side wall, whereas in a left-hand corner block 27, the equivalent wall 102 is recessed slightly into the block. This is to compensate for the offset positions of the end edges of the stretcher blocks caused by the inward 16 and outward 15 bevelled portions of the end walls 10, 11. Moreover, while the overall length of a left hand corner block 27 is slightly more than a right hand corner block 25, this difference is due entirely to the bevelling of the ends. The exposed side wall 6/7 in each case is of the same length as that of a stretcher block. It will be understood, then, that as a wall is constructed, and corners constructed with, alternatively right hand and left hand corners, the outward appearance created is that of a stack of blocks of constant size.

It will be understood that the block, as described, is suitable for use with, or without mortar, or with mortar use only between blocks in a course, with the mortar being placed between adjacent blocks to fill depression 22. Without mortar, or with mortar only in depressions 22 it is desirable to fill the cores of the blocks with concrete or grout after a wall has been erected. The lattice of concrete formed when the cores of the blocks are filled will render the fully constructed wall very strong and water resistant.

Alternatively, a wall constructed with blocks according to the present invention, without the use of mortar, may be surface bonded on at least its outer surface but preferably on its outer and inner surfaces, with a layer of mortar or grout, in order to provide a strong, water impervious structure. Preferably, the surface bonding is done by applying a thin coat of mortar or grout, and then applying a reinforcing fabric layer, such as Bayex 023/271 alkali resistant reinforcement fabric. Lastly, a second layer of mortar or grout is applied, and smoothed over, resulting in an extremely strong and waterproof construction.

The embodiments of the invention in which an exclusive property or privilege is claimed are defined as follows:

1. A building block for use in construction, comprising:

i) a first and second side walls;

ii) first and second end walls joining said first side wall to said second side wall at the respective ends thereof;

iii) a top surface; and iv) a bottom surface, said top and bottom surfaces being profiled to interfit with one another;

characterized in that each said end wall is substantially Z-shaped, each said Z-shaped end wall including an inwardly bevelled portion adjacent the first side wall, an outwardly beveled portion adjacent said second side wall and an angled portion extending between the inner ends of said inwardly and outwardly bevelled portions.

2. A building block for use in construction as claimed in claim 1, further characterized in that the angled portions of the end walls at each end of said block are parallel to one another.

3. A building block for use in construction as claimed in claim 2, further characterized in that a web is provided between said first and second side walls, mid way between said end walls, extending from said top surface to said bottom surface of said block.

4. A building block for use in construction as claimed in claim 3, further characterized in that said web is provided with grooves on its surface, extending from said top surface to said bottom surface of said block.

5. A building block for use in construction as claimed in claim 4, further characterized in that said web is provided with a hollow channel in its interior, extending from the top surface to the bottom surface of said block.

6. A building block for use in construction as claimed in claim 5, further characterized in that said angled portions of said end walls are provided with grooves in their outer surface, extending from the top surface to the bottom surface of said block.

7. A building block for use in construction as claimed in claim 6, further characterized in that said grooves in the outer surface of said angled portions are located in a shallow depression in said outer surface of said angled portion, said shallow depression extending from said top surface to said bottom surface.

8. A building block for use in construction as claimed in claim 7, further characterized in that said inwardly and said outwardly bevelled portions of said end walls are provided with grooves on their outer surface, extending from the top surface to the bottom surface of said block.

9. A building block for use in construction as claimed in claim 7, further characterized in that said inwardly bevelled portion of each said end wall, adjacent its respective side wall, is provided with a short, counter bevelled portion extending from the top surface of said block to the bottom surface thereof.

10. A building block for use in construction as claimed in claim 9, wherein said top surface of said block is provided with a lip at each side edge thereof, each said lip consisting of a horizontal outer ledge, and a bevelled portion extending inwardly thereof.

11. A building block for use in construction as claimed in claim 10, further characterized in that each said bottom surface of said block is provided with a flange at each side edge thereof, each flange consisting of a flat outer edge portion and a bevelled portion inwardly thereof, extending from the bottom surface of the block.

12. A building block for use in construction as claimed in claim 11, further characterized in that the bevelled portion of each said lip is angled at an angle about equal to the angel at which the bevelled portion of each said flange is angled.

13. A building block for use in construction, as claimed in claim 12, further characterized in that the bevelled portion of each said lip is slightly wider than the bevelled portion of each said flange, whereby a gap will be formed between the outer edge of a flange and the ledge of a lip when a block is stacked on another.

14. A building block for use in construction, as claimed in claim 13, further characterized in that one said Z-shaped end wall is off-set at 90° to the other, whereby it is formed in a side wall adjacent to the end of a said block opposite from the outer end wall, to define a corner block.

15. A building block for use in construction, as claimed in claim 14, further characterized in that each said end wall and each said web is provided with a semi-circular cut-out on its upper surface.

16. A building block for use in construction, as claimed in claim 14, wherein said off set end wall is located on the right hand side wall, viewed from above, and said off set Z-shaped end wall consists of an outwardly bevelled portion adjacent the end of said block, an inwardly bevelled portion adjacent said right hand side wall, and an angled portion extending between said bevelled portions of said offset end wall.

17. A building clock for use in construction, as claimed in claim 16, further characterized in that said off set right hand end wall extends outwardly slightly from said side wall.

18. A building block for use in construction as claimed in claim 17, further characterized in that the lip on the upper surface of said block, and the flange on the lower surface of said block extend onto the inwardly bevelled portion of said off set end wall, and around the end of said block adjacent the outwardly bevelled portion of said end wall.

19. A building block for use in construction, as claimed in claim 18, further characterized in that said off set end wall is located on the left hand side wall, viewed from above, and said offset Z-shaped end wall consists of an inwardly bevelled portion adjacent the end wall of said block, and outwardly bevelled portion adjacent said left hand side wall and an angled portion extending between said bevelled portion of said off set end wall.

20. A building block for use in construction, as claimed in claim 19, further characterized in that said off set left hand end wall is depressed inwardly slightly from said side wall.

21. A building block for use in construction as claimed in claim 2, further characterized in that said inwardly and said outwardly bevelled portions of said end walls are provided with grooves on their outer surface, extending from the top surface to the bottom surface of said block.

22. A building block for use in construction as claimed in claim 2, further characterized in that said inwardly bevelled portion of each said end wall, adjacent its respective side wall, is provided with a short, counter bevelled portion extending from the top surface of said block to the bottom surface thereof.

23. A building block for use in construction as claimed in claim 1, wherein said top surface of said block is provided with a lip at each side edge thereof, each said lip consisting of a horizontal outer ledge, and a bevelled portion extending inwardly thereof.

24. A building block for use in construction, as claimed in claim 3, further characterized in that each said end wall and each said web is provided with a semi-circular cut-out on its upper surface.

* * * * *